US008387293B2

(12) United States Patent
Wanibuchi

(10) Patent No.: US 8,387,293 B2
(45) Date of Patent: Mar. 5, 2013

(54) PRINT MEDIUM, WRISTBAND, AND METHOD OF CREATING A WRISTBAND

(75) Inventor: Hiroshi Wanibuchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 101 days.

(21) Appl. No.: 13/078,863

(22) Filed: Apr. 1, 2011

(65) Prior Publication Data

US 2011/0239507 A1 Oct. 6, 2011

(30) Foreign Application Priority Data

Apr. 2, 2010 (JP) ..... 2010-085868

(51) Int. Cl.
*A44C 5/00* (2006.01)

(52) U.S. Cl. ..... 40/633; 428/43

(58) Field of Classification Search ..... 40/633; 428/43

See application file for complete search history.

(56) References Cited

U.S. PATENT DOCUMENTS 6,058,637 A * 5/2000 Duncan ..... 40/633
6,685,228 B2 * 2/2004 Riley ..... 283/109
7,520,078 B2 * 4/2009 Ali et al. ..... 40/633
2005/0262746 A1 * 12/2005 Ali et al. ..... 40/633
2005/0262747 A1 * 12/2005 Ali et al. ..... 40/633
2007/0157498 A1 * 7/2007 Ali et al. ..... 40/633
2009/0277061 A1 * 11/2009 Jain et al. ..... 40/633

FOREIGN PATENT DOCUMENTS

JP 2002-363808 A 12/2002
JP 2010-018905 A 1/2010

* cited by examiner

*Primary Examiner* — Gary Hoge
(74) *Attorney, Agent, or Firm* — Kilpatrick Townsend & Stockton LLP

(57) ABSTRACT

A print medium and methods are provided for producing a die-cut portion easily separable from the print medium, thereby shortening the required time to separate the die-cut portion and reducing wasted consumption of print media. The print medium may include die-cut portions having a contour of a wristband, such as those used in a hospital on the wrist of a patient. The die-cut portions are formed sequentially at a constant interval on the print medium, and die-cut lines are formed between each die-cut portion as lines connecting adjacent die-cut portions. The print medium may be automatically cut at the position of a severance line perpendicular to the die-cut line referenced by a cut mark on the print medium. Because the edges of the severed print medium piece are perpendicular to the die-cut lines, separating the die-cut portion from the print medium can be easily started along the die-cut line.

20 Claims, 2 Drawing Sheets

PRINT MEDIUM, WRISTBAND, AND METHOD OF CREATING A WRISTBAND

This application claims priority to Japanese Application No. 2010-085868, filed Apr. 2, 2010, the entirety of which is incorporated by reference herein.

BACKGROUND

The present invention relates to wristbands, such as those used in hospitals and other facilities, that are worn around the wrist or ankle, for example, of a patient or other user of the facility. The invention also relates to a print medium in which the contour of the wristband is die-cut so that after printing to this die-cut portion the die-cut portion can be removed from the print medium to create the wristband. The invention further relates to a method of creating a wristband using the print medium.

Wristbands displaying personal information such as the patient's name, age, blood type, or the department in which the patient is being treated are commonly used in hospitals and similar facilities to reliably identify individual patients. Such wristbands are wrapped in a circle and typically worn on the patient's wrist or ankle, and once attached are unlikely to come off without being purposely cut.

A web of print media made from a suitable wristband material that is die-cut with the contour of the wristband is used to make such wristbands. This print medium is wound into a roll so that it can be easily loaded into the printer, the personal information is printed onto the die-cut portion of the print medium as it is conveyed from the roll through the printer, and the wristband is then separated from the surrounding waste portion of the print medium by separating the wristband portion from the rest of the print medium along the die cut contour to make a wristband.

Japanese Patent Appl. Pub. JP-A-2002-363808 describes a print medium (strap material) and a wristband created from the strap material. The web of strap material taught in JP-A-2002-363808 is die-cut to create perforations around the shape of the wristband and then wound into a roll, and the roll is loaded into a printer. After the printer prints specific patient information on the wide part of the die-cut wristband shape, the printed portion is discharged from the paper exit of the printer. A perforation for separating one wristband from the next is formed between the printed die-cut portion and the following die-cut portion that is not yet printed. As a result, the printed portion discharged from the paper exit can easily be manually torn off at the perforation. The wristband-shaped part can then be manually separated from the portion of the strap that was torn off at the perforation and used as a wristband.

When the die-cut wristband shape is manually separated, the starting point is typically the most difficult part to grasp, often resulting in wasted print media (strap material) because the beginning of the wristband is not severed along the die-cut lines, or wasted time in trying to find the starting point of the wristband.

JP-A-2002-363808 addresses this problem by forming a continuous cut line instead of a perforation on at least one part of the die-cut shape. More specifically, the semicircular part at one lengthwise end of the wristband shape is cut continuously around the curve instead of being perforated. As a result, when removing the wristband from the print medium web, the semicircular portion at one end can simply be lifted up and pulled towards the opposite end to easily remove the wristband from the surrounding web.

However, when part of the die-cut shape is cut continuously so that it can be easily lifted up and peeled back, the waste portion may be accidentally peeled back with it, resulting in the next unprinted wristband being separated from the web and wasted. More particularly, when the die-cut print medium is wound into rolls for use, the waste portion at the outside edges of the roll can lift up and be accidentally pulled or folded over. If the print medium becomes curled according to the shape of the roll, the waste portion may accidentally lift off the liner. If this occurs in the vicinity of the wristband portion, a large portion of the desired die-cut portion may be accidentally removed before it can be printed, and is thus wasted. The waste portion that gets folded over may also catch on the print mechanism or transportation mechanism inside the printer and cause a paper jam.

BRIEF SUMMARY

A print medium and wristband, and a method of creating a wristband according to the present invention allows for easy removal of the die-cut portion from the print medium, reduced failure in removing the die-cut portion and thereby shortens the time required to produce the wristband, and reduced waste of the print medium.

A first aspect of the invention is a print medium having: separable die-cut portions conforming to the contour of a specific separable shape formed at a regular interval lengthwise to the web; and a separation-starting die-cut portion that is formed for each separable die-cut portion, one end thereof connected to the corresponding separable die-cut portion and intersecting a print medium severance line, the print medium severance line being set transversely to the print medium between the corresponding separable die-cut portion and the separable die-cut portion adjacent thereto.

When the print medium is cut at the severance line with this aspect of the invention, one end of the separation-starting die-cut portion extends to the severed edge so that the separation-starting die-cut portion and the edge of the severed print medium piece intersect. As a result, separation of the separable die-cut portion from the waste portion of the print medium can be started very easily from this intersection. When the print medium is then separated along the separation-starting die-cut portion, the severed part extends to the separable die-cut portion (the contour of the shape to be removed). As a result, separating the desired die-cut portion from the waste portion of the print medium can be easily started from this connection, thereby preventing separation failures. Furthermore, because the separation-starting die-cut portion does not reach the edge of the print medium on the uncut part of the print medium, mishaps such as accidentally tearing the print medium do not occur easily. These aspects are advantageous as they shorten the time required to separate the desired die-cut portion from the waste portion of the print medium and reduce wasted consumption of the print medium.

In another aspect of the invention, one end of the separation-starting die-cut portion is connected to one of two separable die-cut portions that are adjacent to each other along the length of the print medium, and the other end is connected to the other separable die-cut portion. When the print medium is separated along one of two adjacent separable die-cut portions (along the contour of the desired die-cut portion), tearing the separation-starting die-cut portion (the contour line of the separable die-cut portion) connected to the other separable die-cut portion can start from the edge of the contour line where the print medium was already separated. As a result, when a plurality of separable die-cut portions are separated from the print medium web together, there is no need to cut the print medium after each of the separable die-cut portions, and separation can proceed sequentially from the die-cut shape located at the very end of the print medium piece.

In another aspect of the invention, both lengthwise ends of each separable die-cut portion are connected to a separation-starting die-cut portion. This enables separation of the die-cut portion to start from either end. The need to find the starting point is thus eliminated, and the desired die-cut portions can be more easily separated and removed from the print medium web.

In another aspect of the invention, when a printer that cuts the print medium in an automatic cutting process is used, the severance line is the automatic cutting position of the print medium, and a reference mark for the automatic cutting position is formed for each automatic cutting position. This aspect of the invention enables accurate automatic cutting of the print medium at a desired position using an automatic cutting process. As a result, an intersection between the edge of the severed print medium piece and the separation-starting die-cut portion can be reliably formed.

Furthermore, in another aspect of the invention, the separation-starting die-cut portion is preferably perpendicular, or at least substantially perpendicular, to the severance line. Even more preferably, the separation-starting die-cut portion is substantially perpendicular to the separable die-cut portions at the connection to the separable die-cut portion.

When the separation-starting die-cut portions are formed substantially perpendicular to the severed edges of the print medium, one can more easily separate the desired die-cut portion from the surrounding waste portion, thereby preventing mishaps such as tearing the print medium in the wrong place. In addition, separation of the desired shape along the contour line can also easily start where the separation-starting die-cut portion connects the contour line, thereby further preventing separation failures.

In another aspect of the invention, the separation-starting die-cut portion is die-cut using a kiss-cut that leaves part of the thickness of the print medium, or a partial cut that leaves an uncut portion in one part and is through-cut in the other part. The print medium pieces do not rise along the die-cut shape until they are separated with this type of die cut, thereby preventing problems such as the print medium being accidentally separated or a print medium piece catching inside the printer.

In another aspect of the invention, the contour line outlines the contour or shape of a band that is wrapped around an extremity or specific part of the body, such as a wristband wrapped around a patient's wrist, the contour including a printing area for printing information about the person that will wear the wristband. The print medium according to this aspect of the invention can be separated and used as a wristband after personal information is printed by the printer, which is particularly useful for making wristbands as needed.

Another aspect of the invention is a wristband that is created by separating the print medium described above along the separable die-cut portion.

Another aspect of the invention is a method of creating the wristband described above, including steps of: setting the print medium in a printer and printing to the separable die-cut portion while conveying the print medium lengthwise; cutting the print medium along the severance line on the upstream of the printed separable die-cut portion in the transportation direction to expose the intersection of the edge of the severed print medium piece and the separation-starting die-cut portion; and starting separating the print medium along the separable die-cut portion from the connection with the separation-starting die-cut portion after severing the print medium from the exposed intersection to the connection with the separable die-cut portion along the separation-starting die-cut portion.

A method of creating a wristband according to another aspect of the invention includes steps of cutting the print medium along the severance line by means of an automatic cutter mechanism disposed to the printer; and detecting a reference mark for the severance line by means of the printer, and positioning the severance line to the cutting position of the automatic cutter mechanism to cut the print medium. This aspect of the invention enables automatic cutting of the print medium accurately at a desired position. As a result, an intersection with the separation-starting die-cut portion can be reliably formed at the edge of the print medium piece.

According to an embodiment of the invention, when the print medium is cut, one end of the separation-starting die-cut portion extends to the severed edge so that the separation-starting die-cut portion and the edge of the severed piece of print medium intersect. As a result, separation of the separable die-cut portion from the waste portion of the print medium can be started very easily from this intersection. When the print medium is then severed or separated along the separation-starting die-cut portion, the severed part extends to the separable die-cut portion (the contour of the shape to be removed). As a result, separating the desired die-cut portion from the waste portion of the print medium can be easily started from this connection, thereby preventing separation failures. Furthermore, because the separation-starting die-cut portion does not reach the edge of the print medium on the part of the print medium that is uncut, mishaps such as accidentally tearing the print medium do not easily occur. These aspects are advantageous as they shorten the time required to separate the desired die-cut portion from the waste portion of the print medium, and reduce waste of the print medium.

Other objects, aspects and advantages of the inventions together with a fuller understanding of the invention will become apparent and appreciated from the following description and claims taken in conjunction with the accompanying drawings.

DETAILED DESCRIPTION OF THE INVENTION

Preferred embodiments of a print medium, a wristband, and method of creating a wristband according to the invention are described below with reference to the accompanying figures.

Figure 1A:
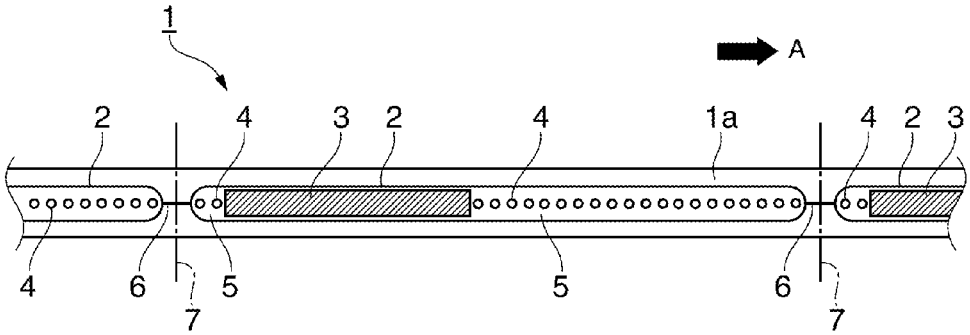
FIGS. 1A-1C includes front, back, and partial section views, respectively, of a print medium according to the invention.
Figure 1B:
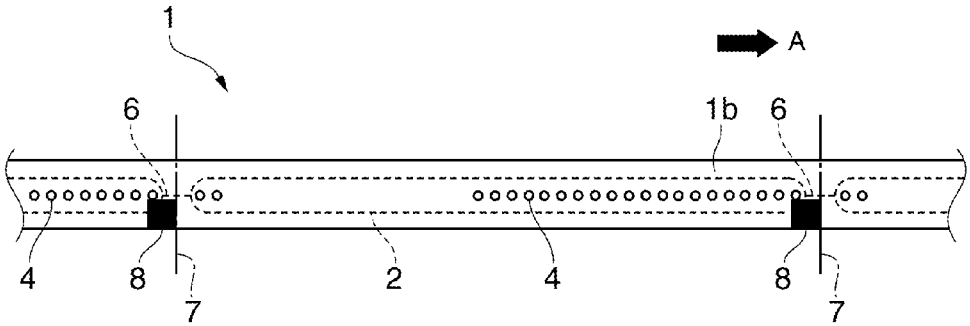
Figure 1C:
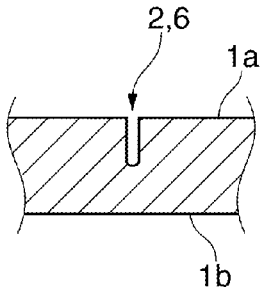

FIG. 1 shows an example of a print medium according to the invention. FIG. 1A is a front view of the part that is die cut along the contour of the wristband, FIG. 1B is a back view of the print medium shown in FIG. 1A, and FIG. 1C is a partial section view showing the die-cut portion in section.

As shown in FIG. 1A and FIG. 1B, the print medium 1 is a web of substantially constant width. Die-cut portions 2 (separable die-cut portions) are die-cut according to the contour of the shape of the desired wristband 12 described below (as shown in FIG. 3B). Die-cut portions 2 are sequentially formed with a constant gap therebetween along the length of the print medium 1. The print medium 1 is made from a material that is suitable for use as a wristband 12 so that it may be worn or wrapped around an extremity of a wearer, for example, the wrist or ankle of a patient in a hospital. In such an embodiment, the print medium 1 is made from a water-resistant, medically-safe polyurethane material.

Each die-cut portion 2 extends a substantially constant width along the length of the print medium 1 between two semi-circular ends. A printing area 3 for printing patient information, for example, is rendered on the front side 1*a* of the print medium 1 at a position near one lengthwise end of each die-cut portion 2. At least this printing area 3 on the front side 1 a of the print medium 1 is suitable for being printed on by an inkjet printer. Holes 4 are formed at a substantially constant interval in the parts of each die-cut portion 2 outside the printing area 3, thus creating straps 5. These holes 4 pass through the print medium 1, and are formed along the center line of the width of the die-cut portion 2.

The die-cut portions 2 are formed sequentially with the semicircular ends of adjacent die-cut portions 2 opposite each other. A straight die-cut line 6 (separation-starting die-cut portion) that extends between opposing ends of adjacent die-cut portions 2 are formed in the front side 1*a* of the print medium 1. Because the die-cut line 6 is formed on the center line of the width of the die-cut portion 2, the ends of each die-cut line 6 are substantially perpendicular at the connection to the apex of the semicircular end of each die-cut portion 2. Preferably, a die-cut line 6 is formed between the ends of any two adjacent die-cut portions 2 so that a die-cut line 6 is connected to both ends of each die-cut portion 2.

As shown in FIG. 1B, a cut mark 8 defines the position of a print medium 1 severance line 7 that is substantially perpendicular to the die-cut line 6. The cut mark 8 is added to the back side 1*b* of the print medium 1 as shown in FIG. 1B. The severance line 7 is the position where the automatic cutter of the printer 9 described below cuts the print medium 1 crosswise or transverse to the print medium 1. Each cut mark 8 is located on the upstream side of the corresponding severance line 7 in the direction (the direction of arrow A in FIG. 1A and FIG. 1B) in which the print medium 1 is conveyed for printing through the printer 9 described below. Although in the exemplary embodiment, each cut mark 8 is located on the upstream side of the severance line 7, one of skill in the art would appreciate that the cut mark could be located on the downstream side of the severance line 7 or at any location to enable the printer 9 to cut the print medium 1 at the desired severance line 7.

As shown in FIG. 1C, for example, the wristband 12 and die-cut line 6 may be kiss-cut to a depth of approximately half the thickness of the print medium 1. Note that the die-cut portion 2 and die-cut line 6 may also be die-cut to form a perforation. Alternatively, the die-cut line 6 may be partially cut, leaving a small part of the line uncut while the rest of the line is through-cut. For example, the die-cut line 6 could be formed with one point in the middle uncut and the other parts on either side thereof through-cut.

Figure 2:
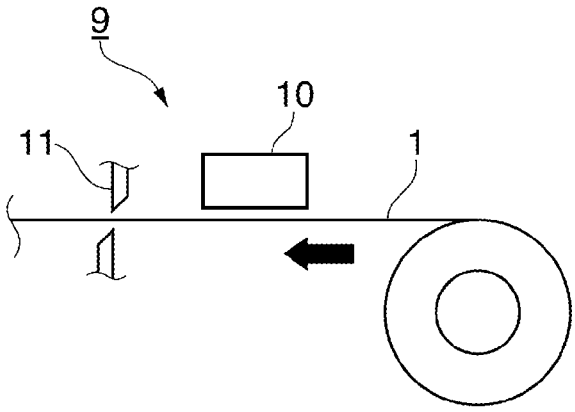
FIG. 2 schematically describes a printer for printing on the print medium shown in FIG. 1.

FIG. 2 describes the configuration of a printer that prints on print medium 1 described above. As shown in FIG. 2, the print medium 1 is wound in a roll and set inside the printer 9. The print medium 1 that is pulled off the roll is conveyed through the transportation path inside the printer 9 in the printing direction A as shown in FIG. 1A and FIG. 1B. The printer 9 prints to the printing area 3 (not shown) as the printing area 3 passes the printing position of the inkjet head 10. Each printing area 3 is printed based on print data containing patient information sent from a host device (not shown).

When printing is completed, the printer 9 conveys the part of the print medium 1 having the die-cut portion 2 containing the printing area 3 that was printed on, past the cutting position of the automatic cutter mechanism 11 so that it is discharged to the outside from the paper exit of the printer 9. Once the part of the print medium 1 having the die-cut portion 2 is discharged to the outside, the cut mark 8 on the back side 1*b* of print medium 1 is detected by a photo sensor (not shown). The photo sensor may be disposed at an appropriate position on the upstream side of the cutting position. Based on the output from the photo sensor detector, the severance line 7 (as shown in FIG. 1) between the die-cut portion 2 containing the printing area 3 that was printed and the unprinted die-cut portion 2 located upstream therefrom in the transportation direction is positioned to the cutting position. The print medium 1 is then cut at the severance line 7 by automatic cutter mechanism 11. By executing the automatic cutter process 11 based on the detection of cut marks 8, the print medium 1 can be accurately cut automatically at the position of severance line 7. Note that in other embodiments, the cut mark 8 and/or photo sensor could be at any number of locations on the print medium or printer suitable for determining the position of the printing area 3 to allow automatic cutting of the die-cut portion 2 having a printed printing area 3 thereon. For example, the cut mark 8 could be located on the upstream side of the printing position, and the transportation position of the printing area 3 determined and the printing area 3 positioned to the printing position based on the location of the cut mark 8.

Figure 3A:
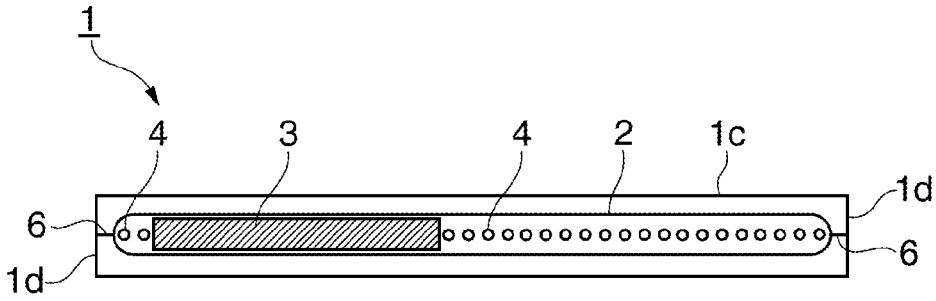
FIGS. 3A-3B shows the printed medium before and after separation from the web of print media.
Figure 3B:
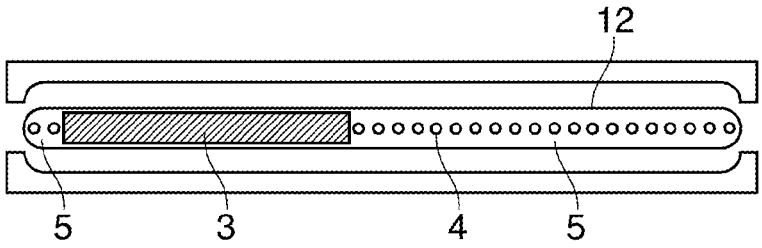

FIG. 3 shows a piece of the print medium separated from the surrounding web or waste portion, FIG. 3A showing the print medium before the wristband is removed, and FIG. 3B showing the print medium after the wristband is removed from the web. As shown in FIG. 3A, both lengthwise ends of the print medium piece 1*c* are edges 1*d* that are cut across the severance line 7, and the die-cut lines 6 intersect with and extend substantially perpendicular to the edges 1*d*. When both ends of the die-cut portion 2 are thus connected to a die-cut line 6 and the die-cut lines 6 extend to the edges 1*d*, removing the die-cut portion 2 from the print medium 1 can be easily started from either edge 1*d* at the intersection of the die-cut line 6 with severed edge 1*d*. The print medium 1 can then be severed or separated along the die-cut line 6 to the intersection of die-cut line 6 with the die-cut portion 2, and removal of the die-cut portion 2 can be easily started from this intersection. Thus, a wristband 12 as shown in FIG. 3B can therefore be easily separated from the waste portion of the print medium 1.

The separated wristband 12 is then wrapped around the patient's wrist with the printing area 3 side to the outside so that the patient's information printed thereon is visible, and the straps 5 on each end are put together so that the holes 4 overlap so as to allow fastening or attachment of the strap onto the patient. The wristband 12 is then attached to the wrist or ankle of the patient by passing a clip or other fastener through overlapping holes 4 and securing the fastener so that it cannot be easily removed.

By printing and then cutting the print medium 1 in an automatic cutting process, one end of the die-cut line 6 is formed perpendicularly to the cut edge 1*d* of the print medium piece 1*c* in which the printed die-cut portion 2 is formed. The print medium piece 1*c* that was printed can therefore be separated starting from the die-cut line 6 to the intersection with the die-cut portion 2 and die-cut line 6, and separation can then continue along the die-cut portion 2 until separation of the entire die-cut portion 2 from the waste portion of the print medium 1. These aspects of the present invention allow wristband 12 to be easily separated from the rest of the print medium 1 with few failures. In addition, because the die-cut line 6 only meets an edge of the print medium 1 once the print medium 1 is cut, failures caused by accidentally starting to tear or separate the print medium 1 along the die-cut line 6 cannot easily occur. As a result, these elements thereby shorten the time required to separate a wristband 12 from the print medium, and reduce wasteful consumption of print medium 1 by reducing the possibility of separation failures.

More particularly, in this embodiment of the invention, the die-cut line 6 intersects the severance line 7 and the contour line of the die-cut portion 2. As a result, there are few failures from starting to separate the die-cut line 6 and starting to separate the die-cut portion 2. In addition, as shown in FIG. 3A, when both lengthwise ends of the die-cut portion 2 are cut, separating the die-cut portion 2 can start from the die-cut line 6 at either end, thereby eliminating the need to look for the starting position and further reducing the time needed to separate the die-cut portion 2 from the waste portion.

When producing a plurality of wristbands 12, the print medium 1 may be cut after printing the required number of die-cut portions 2 instead of cutting the print medium 1 after printing each die-cut portion 2 as shown in FIG. 3A, thus forming a print medium piece 1*c* containing a plurality of printed die-cut portions 2. In this case, separating the die-cut portions 2 can start from the die-cut portion 2 at either end of the length of the print medium piece 1*c*. Separating the next die-cut portion 2 then starts by separating the die-cut line 6 formed between the end of the separated die-cut portion 2 and the next adjacent die-cut portion 2, and this process continues to separate each adjacent die-cut portion 2 from the waste portion in succession. Thus, since the die-cut line 6 connects adjacent die-cut portions 2, this embodiment of the invention allows a plurality of wristbands 12 to be easily separated from the waste portion matrix. Other embodiments (1) The die-cut line 6 and severance line 7 are substantially perpendicular to each other in the embodiment described above, but the intersection therebetween does not need to be perpendicular and can be any angle within a specific angular range of perpendicular. If the intersection angle between the die-cut line 6 and the edges 1*d* of the print medium piece 1*c* is too small, finding the start of the die-cut line 6 is difficult and starting separating the pieces is not particularly easy, but if the intersection angle is large enough, starting separating the pieces is extremely simple. The intersection between the die-cut line 6 and the die-cut portion 2 is also not limited to perpendicular, and may be at an angle within a certain angular range centered on perpendicular.

(2) The die-cut line 6 is formed connecting adjacent die-cut portions 2 in the foregoing embodiment, but may be formed to a length such that one end of each die-cut line 6 connects to the trailing end of the die-cut portion 2 in the printing (transportation) direction, and the other end of the die-cut line 6 extends to or slightly past the position of the severance line 7 without extending completely to the next adjacent die-cut portion 2. When thus configured, the severed edge 1*d* of the cut off print medium piece intersects the die-cut line 6, while the die-cut line 6 connected to the subsequent die-cut portion 2 on the roll will not connect to the edge 1*d* of the print medium 1 on the side that remains connected to the roll. As a result, mishaps such as accidentally starting to tear the print medium 1 on the side connected to the roll will not easily occur.

(3) A print medium 1 that can be printed on by an inkjet printer 9 using an inkjet print method is used in the foregoing embodiments, however, the invention can also be applied to printers that print using methods other than inkjet printing and to print media compatible with such printers.

(4) The print medium 1 in the foregoing embodiments has a die-cut portion 2 formed with the contour of a wristband 12, but the invention can also be used with print media that are die-cut with any desired shape, including shapes other than a wristband 12. For example, the invention can be applied to print media for creating information tags affixed to animals instead of people, or tags that are attached to objects other than living organisms. The invention can also be used with print media for creating other types of labels and display tags.

(5) The print medium 1 is automatically cut by an automatic cutter mechanism 11 during printing in the foregoing embodiments, however, the print medium 1 could be cut manually instead. For example, a manual cutter mechanism could be disposed to the paper exit of the printer, the print medium 1 conveyed to position the severance line 7 to the cutter, and the user could then manually cut the print medium 1.

The invention being thus described, variations of the present invention may become apparent to one of ordinary skill in the art. Such variations are not to be regarded as a departure from the spirit and scope of the invention, and all such modifications are intended to be included within the scope of the following claims.

What is claimed is:

1. A print medium comprising:

a plurality of separable die-cut portions sequentially formed at regular intervals along a length of the print medium, each of the plurality conforming to a contour of a desired separable shape; and a separation-starting die-cut portion formed for each separable die-cut portion of the plurality, wherein the separation-starting die-cut portion has at least one end connected to the corresponding separable die-cut portion, and intersects a print medium severance line between the corresponding separable die-cut portion and an adjacent separable die-cut portion.

2. The print medium of claim 1 wherein, the separation-starting die-cut portion has another end connected to the adjacent separable die-cut portion.

3. The print medium of claim 1, wherein the separation-starting die-cut portion has another end that terminates on the print medium a distance away from the adjacent separable die-cut portion.

4. The print medium of claim 2, wherein each separable die-cut portion comprises opposing lengthwise ends, both lengthwise ends of each separable die-cut portion being connected to a separation-starting die-cut portion.

5. The print medium of claim 1, wherein:

the severance line is an automatic cutting position of the print medium when a printer that cuts the print medium in an automatic cutting process is used; and a reference mark for detecting the automatic cutting position is disposed on the print medium for each automatic cutting position.

6. The print medium of claim 1, wherein the separation-starting die-cut portion is substantially perpendicular to the severance line at the intersection of the separation-starting die-cut portion with the severance line.

7. The print medium of claim 1, wherein the separation-starting die-cut portion is substantially perpendicular to the separable die-cut portions at the connection of the separation-starting die-cut portion to the separable die-cut portion.

8. The print medium of claim 1, wherein the separation-starting die-cut portion is die-cut using a kiss-cut that leaves part of the thickness of the print medium or a partial cut that leaves an uncut portion in one part and is through-cut in another part.

9. The print medium of claim 1, wherein the contour line is the contour of a wristband suitable for wrapping around a wrist of a patient that includes a printing area suitable for printing information about the patient inside the printing area surrounded by the contour line.

10. A wristband comprising the separable die-cut portion of the print medium of claim 1 separated along the separable die-cut portion.

11. A method of creating a patient identification band, comprising steps of:

setting a print medium in a printer, the print medium comprising a plurality of separable die-cut portions formed at regular intervals along a length of the print medium, wherein each of the plurality connects to a separation-starting die-cut portion;

printing on at least one separable die-cut portion of the plurality while conveying the print medium in a transportation direction running lengthwise to the print medium;

cutting the print medium between adjacent die-cut portions such that a severed edge of the cut print medium intersects a separation-starting die-cut portion connected to the at least one separable die-cut portion having been printed on; and starting separating the print medium along the separation-starting die cut portion at the intersection of the separation-starting die cut portion with the severed edge of the cut print medium; and separating the at least one separable die-cut portion along the die-cut portion starting from the connection of the separation-starting die-cut portion with the die-cut portion.

12. The method of claim 11, wherein cutting the print medium comprises cutting the print medium between the at least one separable die-cut portion having been printed on and the adjacent die-cut portion upstream of the at least one separable die-cut portion in the transportation direction.

13. The method of claim 11, wherein cutting the print medium comprises cutting the print medium along a severance line on the print media, the severance line being substantially transverse to the lengthwise direction and between adjacent die-cut portions.

14. The method of claim 13, wherein cutting the print medium is performed manually.

15. The method of claim 13, wherein cutting the print medium is performed automatically by a cutter mechanism of the printer based on detection of a reference cut mark on the print media with a sensor of the printer.

16. The method of claim 15, wherein the cut mark is disposed on the print medium upstream from the severance line in the transportation direction.

17. The method of claim 15, wherein cutting the print medium along the severance line by means of the automatic cutter mechanism further comprises detecting the reference mark for the severance line by the sensor, and positioning the severance line to a cutting position of the automatic cutter mechanism to cut the print medium along the severance line.

18. The method of claim 11, wherein printing further comprises printing information corresponding to a patient on a print area within the separable die-cut portion.

19. The method of claim 18, wherein the separated die-cut portion comprises a patient identification band, the method further comprising:

wrapping the patient identification band around an extremity of the patient so as to overlap opposite ends of the patient identification band to align holes disposed in the band near opposite ends of the band; and fastening the band on the patient by passing a fastener through the aligned holes of the band while wrapped around the extremity of the patient.

20. The method of claim 17, further comprising:

printing to one or more subsequent die-cut portion of the plurality while conveying the print medium in the transportation direction, and wherein cutting the print medium comprises cutting the print medium between adjacent separable die-cut portions such that the cut print media comprises the at least one die-cut portion and the one or more subsequent die-cut portions having been printed on.

* * * * *